US010514192B2

(12) United States Patent
Ha et al.

(10) Patent No.: US 10,514,192 B2
(45) Date of Patent: Dec. 24, 2019

(54) DEHUMIDIFIER

(71) Applicant: LG ELECTRONICS INC., Seoul (KR)

(72) Inventors: Jongchul Ha, Seoul (KR); Jiwon Chang, Seoul (KR); Yeol Lee, Seoul (KR); Hyunjong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 813 days.

(21) Appl. No.: 14/547,209

(22) Filed: Nov. 19, 2014

(65) Prior Publication Data

US 2015/0159889 A1 Jun. 11, 2015

(30) Foreign Application Priority Data

Dec. 10, 2013 (KR) ..... 10-2013-0153235

(51) Int. Cl.

| | |
|---|---|
| ***F24F 3/14*** | (2006.01) |
| ***F25B 49/02*** | (2006.01) |
| ***F24F 3/153*** | (2006.01) |
| *F24F 13/22* | (2006.01) |
| *F24F 140/30* | (2018.01) |

(52) U.S. Cl.
CPC ..... *F25B 49/02* (2013.01); *F24F 3/153* (2013.01); *F24F 2003/144* (2013.01); *F24F 2013/227* (2013.01); *F24F 2140/30* (2018.01)

(58) Field of Classification Search
CPC ..... F24F 2003/144; F24F 3/1405
USPC ..... 62/305, 174
See application file for complete search history.

(56) References Cited

U.S. PATENT DOCUMENTS

| | | | | |
|---|---|---|---|---|
| 7,340,912 | B1 * | 3/2008 | Yoho, Sr. | F24F 3/1423 62/305 |
| 7,370,490 | B2 * | 5/2008 | Li | F24F 1/0003 62/305 |
| 9,032,748 | B2 * | 5/2015 | Lau | F04D 15/029 417/3 |
| 9,109,809 | B2 * | 8/2015 | Kim | F24F 3/0442 |
| 2004/0040322 | A1 * | 3/2004 | Engel | F24F 3/1405 62/177 |

FOREIGN PATENT DOCUMENTS

| | | |
|---|---|---|
| CN | 101178206 A | 5/2008 |
| CN | 101344290 A | 1/2009 |

(Continued)

*Primary Examiner* — Jianying C Atkisson
*Assistant Examiner* — Meraj A Shaikh
(74) *Attorney, Agent, or Firm* — Birch, Stewart, Kolasch & Birch, LLP

(57) ABSTRACT

A dehumidifier includes a body having an inlet for suctioning air and an outlet for discharging air; a compressor, disposed at the body, for compressing a refrigerant; a condenser for condensing the refrigerant compressed from the compressor; an expander for expanding the refrigerant condensed from the condenser; an evaporator, disposed at upstream of the condenser according to the flow direction of air, for evaporating the refrigerant expanded from the expander; a condensate water tank to store condensate water condensed from the evaporator; and a condensate water pipe, connected to the condensate water tank, for flowing the condensate water to be heat-exchanged with the refrigerant compressed from the compressor.

11 Claims, 7 Drawing Sheets

(56) References Cited

FOREIGN PATENT DOCUMENTS

| | | | | |
|---|---|---|---|---|
| CN | 201218625 | Y | | 4/2009 |
| CN | 201242340 | Y | | 5/2009 |
| CN | 101509684 | A | | 8/2009 |
| CN | 101619876 | A | | 1/2010 |
| CN | 101676641 | A | * | 3/2010 |
| CN | 101676641 | A | | 3/2010 |
| CN | 101957031 | A | | 1/2011 |
| CN | 201748559 | U | | 2/2011 |
| EP | 2431676 | A2 | | 3/2012 |
| JP | 4-306425 | A | | 10/1992 |
| JP | 04306425 | A | * | 10/1992 |

* cited by examiner

DEHUMIDIFIER

CROSS-REFERENCE TO RELATED APPLICATIONS

The present application claims priority under 35 U.S.C. 119 and 35 U.S.C. 365 to Korean Patent Application No. 10-2013-0153235 (filed on Dec. 10, 2013), which is hereby incorporated by reference in its entirety.

BACKGROUND

The present disclosure relates to a dehumidifier.

In general, the dehumidifier lowers indoor humidity by suctioning wet air at an indoor space into the interior of a case, lowering humidity after passing through a heat exchanger configured with a condenser and an evaporator allowing a refrigerant to flow, and again discharging the dehumidified air into the indoor space.

SUMMARY

Embodiments provide a dehumidifier for minimizing sensitivity dissatisfaction for a user by lowering the temperature of dehumidified air to be discharged.

In one embodiment, a dehumidifier includes: a body having an inlet for suctioning air and an outlet for discharging air; a compressor, disposed at the body, for compressing a refrigerant; a condenser for condensing the refrigerant compressed from the compressor; an expander for expanding the refrigerant condensed from the condenser; an evaporator, disposed at upstream of the condenser according to the flow direction of air, for evaporating the refrigerant expanded from the expander; a condensate water tank to store condensate water condensed from the evaporator; and a condensate water pipe, connected to the condensate water tank, for flowing the condensate water to be heat-exchanged with the refrigerant compressed from the compressor.

In another embodiment, a dehumidifier includes: an inlet for suctioning air; a compressor, disposed at a body, for compressing a refrigerant; a condenser for condensing the refrigerant compressed from the compressor; an evaporator disposed at upstream of the condenser according to the flow direction of air; an outlet for discharging air heat-exchanged with the condenser; a condensate water tank to store condensate water condensed from the evaporator; and a condensate water pipe, connected to the condensate water tank, for flowing the condensate water to be heat-exchanged with the refrigerant discharged from the compressor, and for collecting the heat-exchanged condensate water into the condensate water tank.

The details of one or more embodiments are set forth in the accompanying drawings and the description below. Other features will be apparent from the description and drawings, and from the claims

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
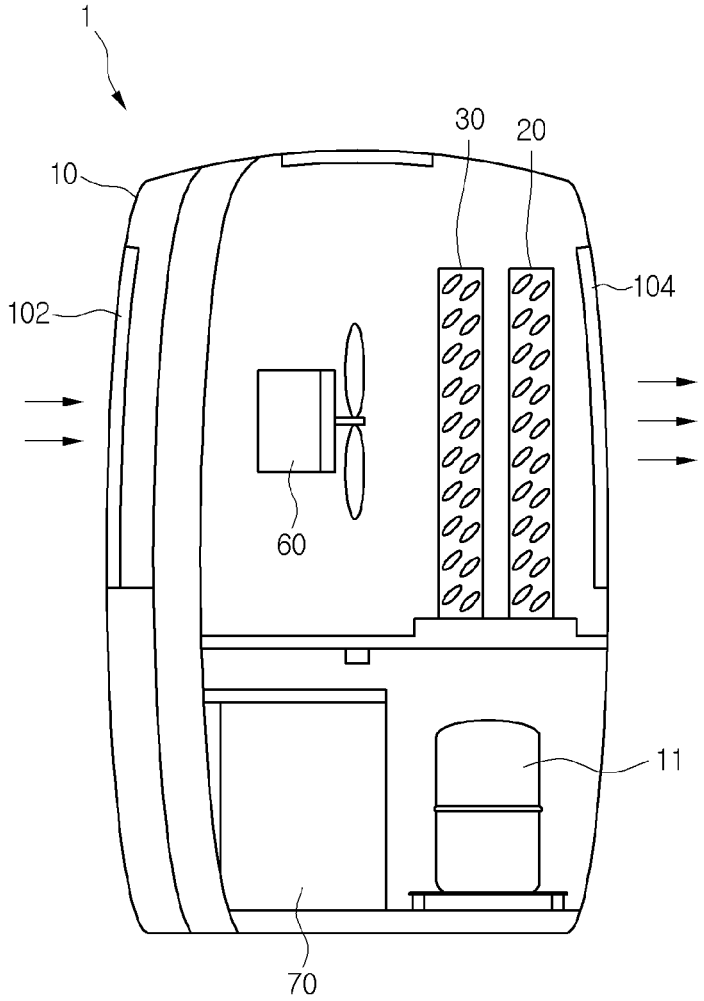
FIG. 1 schematically shows internal configurations of a dehumidifier according to a first embodiment of the present invention.
Figure 2:
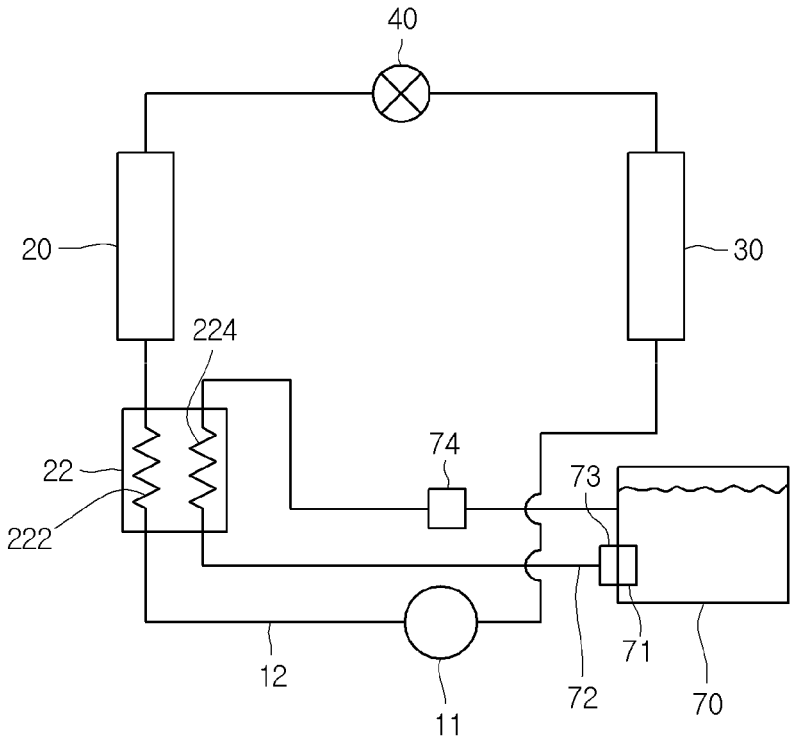
FIG. 2 shows configurations of the dehumidifier according to the first embodiment of the present invention.

FIG. 1 schematically shows internal configurations of a dehumidifier according to a first embodiment of the present invention, and FIG. 2 shows configurations of the dehumidifier according to the first embodiment of the present invention.

Referring to FIG. 1 and FIG. 2, the dehumidifier 1 in a first embodiment includes a body 10 for forming an outer shape.

The body 10 may include an inlet 102 for suctioning air, an outlet 104 for discharging air, and a fan 60 capable of flowing air.

Further, the body 10 further includes a compressor 11 for compressing a refrigerant, a condenser 20 for condensing the refrigerator compressed from the compressor 11, an expander 40 for expanding the refrigerator condensed from the condenser 20, and an evaporator 30 for evaporating the refrigerator expanded from the expander 40.

The fan 60 may be disposed at upstream of the evaporator 30 according to the flow direction of air, but may be disposed at downstream of the condenser 20.

The evaporator 30 is disposed at upstream of the condenser 20 according to the flow direction of air. Therefore, air suctioned through the inlet 102 by operating the fan 60 is heat-exchanged with the evaporator 30 and dehumidified, and is discharged outside through the outlet 104 after heat-exchanging with the condenser.

The body 10 may further include condensate water tank 70 for storing condensate water. The condensate water tank 70 may be separately coupled with the body 10, and it is possible to empty the condensate water stored into the condensate water tank 70 on separating the condensate water tank 70 from the body 10.

The condensate water tank 70 may be connected with a condensate water pipe 72 for flowing the condensate water again after discharging the condensate water outside the condensate water tank 70. For an example, the condensate water tank 70 is formed with a connection portion 71 for connecting the condensate water pipe 72, and an end portion of the condensate water pipe 72 or the connection portion 71 may be disposed with a valve 73. Therefore, when the condensate water tank 70 is separated from the body 10, the valve 73 is closed, and when the condensate water tank 70 is mounted at the body 10, the valve 73 is opened.

The body 10 may further include a heat exchanger 22 for heat-exchanging the condensate water discharged from the condensate water tank 70 with the refrigerant discharged from the compressor 11.

The heat exchanger 22 lowers temperature of the refrigerant, having high temperature, discharged from the compressor 11 before the refrigerant flows into the condenser 20 by the condensate water.

The heat exchanger 22 may be disposed with the connection pipe 12 for connecting the compressor 11 and condenser 20. For an example, the heat exchanger 22 may include a refrigerant flow path 222 for flowing the refrigerant, and a condensate water flow path 224 for flowing the condensate water. In addition, the condensate water flow path 224 may be connected with the condensate water pipe 72. As another example, it is possible that the connection pipe 12 and the condensate water pipe 72 penetrate the heat exchanger 22.

The condensate water pipe 72 may be disposed with a pump 74 capable of flowing the condensate water.

The heat exchanger 22 is separated with the condenser in the above embodiment, but, on the other hand, the condensate water pipe 72 contacts the condenser 20, thereby to heat-exchange the refrigerant for flowing the condenser 20 and the condensate water for flowing the condensate water pipe 72.

As another example, the inside of the condenser 20 may be provided with a condensate water flow path for flowing the condensate water on the sidelines of the refrigerant flow path for flowing the refrigerant, and it is possible to connect the condensate water pipe 72 to the condensate water flow path.

As further another example, it is possible to dispose the condensate water pipe 72 for flowing the condensate water at downstream of the condenser 20. In this case, air passing through the condenser 20 is heat-exchanged with the condensate water in the condensate water pipe 72 to lower temperature.

As further another example, the heat exchanger includes a refrigerant flow path, and it is possible to configure the condensate water pipe to be contacted with the heat exchanger.

Figure 3:
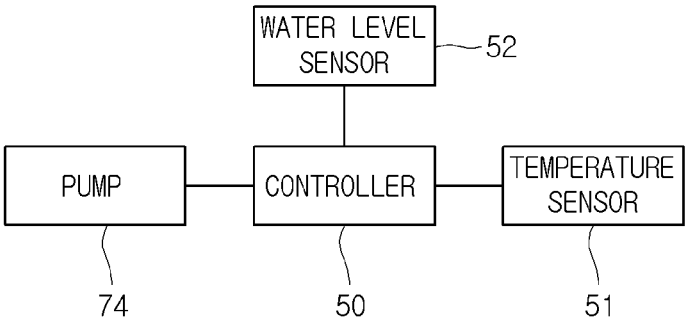
FIG. 3 is a block view for controlling the dehumidifier according to the first embodiment of the present invention.

FIG. 3 is a block view for controlling the dehumidifier according to a first embodiment of the present invention.

Referring to FIG. 3, the dehumidifier 1 in the present embodiment may include a temperature sensor 51 for sensing the temperature of the condensate water, a water level sensor 52 for sensing the water level of the condensate water at the condensate water tank 70, and a controller 50 for controlling flow of the condensate water at the condensate water pipe 72 based on information sensed by the temperature sensor 51 and the water level sensor 52.

The temperature sensor 51 may be disposed at a portion, where the condensate water flows, before the condensate water is heat-exchanged with the refrigerant at the condensate water tank 70 or the condensate water pipe 72.

Figure 4:
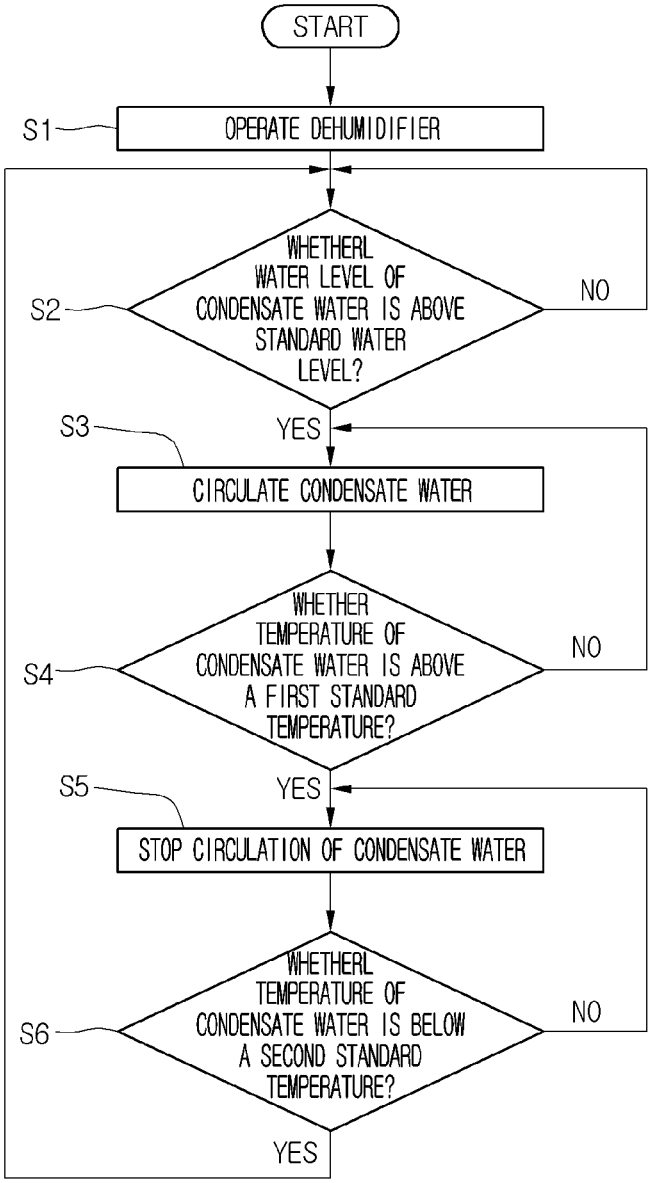
FIG. 4 describes a method for controlling the dehumidifier according to the first embodiment of the present invention.

FIG. 4 describes a method for controlling the dehumidifier according to the first embodiment of the present invention.

Referring to FIG. 2 to FIG. 4, the dehumidifier is powered on to operate the dehumidifier 1 (S1).

When the dehumidifier 1 is operated, the refrigerant compressed from the compressor 11 passes through the heat exchanger 22 and then is flown into the condenser 20. The refrigerant flown into the condenser 20 is condensed and then is expanded by the expander 40. The refrigerant expanded by the expander 40 is evaporated by the evaporator 30 and then is flown into the compressor 11.

When the dehumidifier 1 is operated, air blown by the fan 60 is dehumidified and the temperature of it is lowered on passing through the evaporator 30, the temperature of it is raised on passing through the condenser 20, and air is discharged from the body 10 through the outlet 104.

When the dehumidifier 1 is operated, the water level of the condensate water is sensed at the water level sensor 52, and the controller 50 determines whether the water level of the sensed condensate water is above standard water level (S2).

In general, when the dehumidifier 1 is operated in a state that the condensate water tank 70 is empty, constant time is required until the water level of the condensate water for the condensate water tank 70 becomes above the standard water level. When the water level of the condensate water at the condensate water tank 70 is under the standard water level, the condensate water is not circulated on operating the pump 74 or heat exchange time may be reduced because the temperature of the condensate water is quickly raised by heat-changing the condensate water with the refrigerant on circulating the condensate water.

Therefore, on determining at Step (S2) in the present embodiment, when the water level of the condensate water is above the standard water level, the controller 50 operates the pump 74 and therefore controls circulation (flow for the condensate water) for the condensate water to circulate the condensate water at the condensate water pipe 72.

When the pump 74 is operated, the condensate water stored into the condensate water tank 70 is flown along with the condensate water pipe 72 and is flown into the condensate water tank 70 again after heat-exchanging with the refrigerant, having high temperature, discharged from the compressor 11 in the heat exchanger 22.

When the temperature of the condensate water stored into the condensate water tank 70 refers to T1 and the temperature of the refrigerant discharged from the compressor refers to T2, T2 is considerably larger than T1 and therefore the temperature of the refrigerant having high temperature is lowered on heat-exchanging with the condensate water, and the refrigerant having lowered temperature passes through the condenser 20.

Therefore, condensation temperature of the condenser 20 is lowered and therefore the temperature, after passing through the condenser, for air dehumidified while passing through the evaporator 30 become low as compared with the temperature of air heat-exchanged with the condenser when the refrigerant, that is not heat-exchanged with the condensate water, passes through the condenser 20.

Therefore, the temperature for air discharged from the dehumidifier is lowered, thereby to enhance the interior comfort and to minimize sensitivity dissatisfaction of a user.

When the condensate water is circulated, the temperature sensor 51 senses the temperature of the condensate water and the controller 50 determines whether the temperature of the condensate water is above a first standard temperature (S4).

When the condensate water is heat-exchanged with the refrigerant on circulating, the temperature of the condensate water is raised. When the temperature of the condensate water is above the first standard temperature, temperature lowering effect for the refrigerant is removed on heat-exchanging the condensate water with the refrigerant. Therefore, on determining at Step (S4), when the temperature of the condensate water is above the first standard temperature, the controller 50 stops an operation of the pump 74 to stop circulation of the condensate water (S5) (flow control for the condensate water).

In addition, after the circulation of the condensate water is stopped, the controller 50 determines whether the temperature of the condensate water is below a second standard temperature lower than the first standard temperature (S6).

On determining at Step (S6), when the temperature of the condensate water is below the second standard temperature lower than the first standard temperature, it returns to Step (S2). That is, after determining whether the water level of the condensate water reaches the standard water level, the condensate water is circulated again in the case that the water level of the condensate water is above the standard water level.

When it determines whether the temperature of the condensate water is below the first standard temperature, the pump 74 is frequently powered on or off in the case that the temperature of the condensate water is raised or lowered in the vicinity of the first standard temperature and unnecessary power is consumed. To avoid this, it determines whether the temperature of the condensate water is below the second standard temperature lower than the first standard temperature in the present embodiment.

Figure 5:
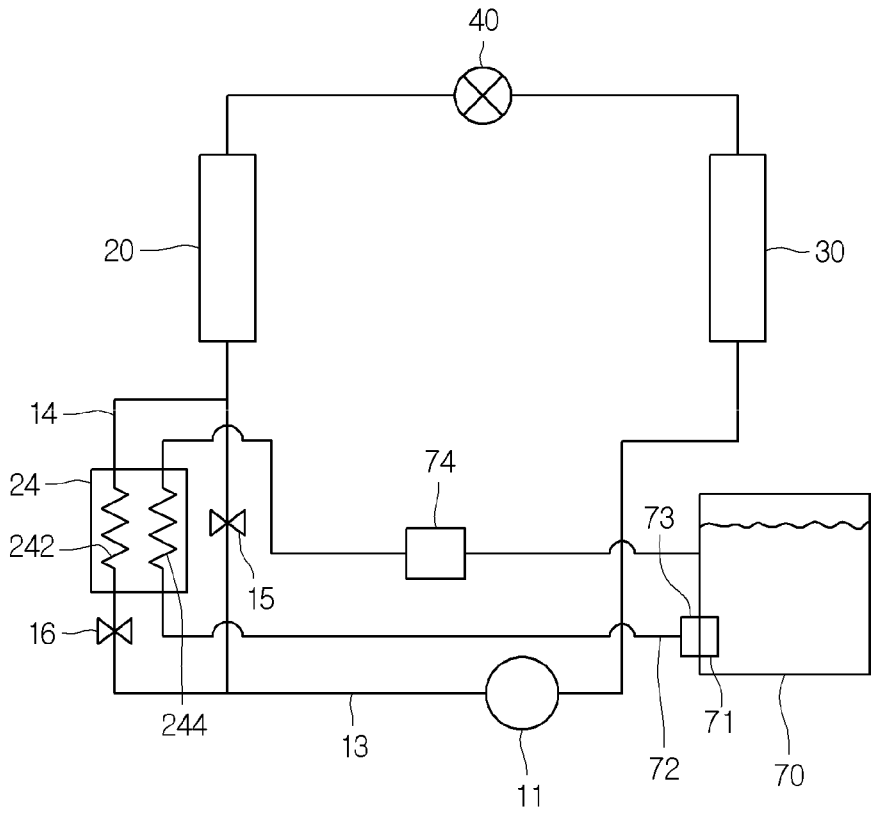
FIG. 5 schematically shows the dehumidifier according to a second embodiment of the present invention.

FIG. 5 schematically shows the dehumidifier according to a second embodiment of the present invention.

Some other sections of the present embodiment are the same as the first embodiment, and there is a difference for the flow path of the refrigerant and the condensate water. Therefore, hereinafter, characteristic sections only in the present embodiment will be described.

Referring to FIG. 5, the dehumidifier 1 in the second embodiment includes a diverge pipe 14 diverged from a connection pipe 13 connecting the compressor 11 and the condenser 20.

In addition, the heat exchanger 24 for heat-exchanging the refrigerant with the condensate water is disposed on the diverge pipe.

For an example, the heat exchanger 24 may include a refrigerant flow path 242 for flowing the refrigerant, and a condensate water flow path 244 for flowing the condensate water. In addition, the condensate water flow path 244 may be connected with the condensate water pipe, 72. As another example, it is possible that the diverge pipe 14 and the condensate water pipe 72 penetrate the heat exchanger 24. The condensate water pipe 72 may be disposed with a pump 74 capable of flowing the condensate water.

In addition, the connection pipe 13 is provided with a first valve 15, and the diverge pipe 14 is provided with a second valve 16. The first valve 15 controls the flow for the refrigerant at the connection pipe 13, and the second valve 16 controls the flow for the refrigerant at the diverge pipe 14.

Hereinafter, operations of the dehumidifier in the present embodiment will be described.

When the dehumidifier 1 is operated, the first valve 15 is opened and the second valve 16 is closed.

Then, the refrigerant compressed from the compressor 11 is flown into the condenser 20 without passing through the heat exchanger 24. The refrigerant flown into the condenser 20 is condensed and then is expanded by the expander 40. The refrigerant expanded by the expander 40 is evaporated by the evaporator 30 and then is flown into the compressor 11.

When the dehumidifier 1 is operated, air blown by the fan 60 is dehumidified and the temperature of it is lowered on passing through the evaporator 30, the temperature of it is raised on passing through the condenser 20, and air is discharged into the body 10 through the outlet 104.

When the dehumidifier 1 is operated, the water level of the condensate water is sensed at the water level sensor 52, and the controller 50 determines whether the water level of the sensed condensate water is above the standard water level.

When the water level of the condensate water is above the standard water level, the controller 74 operates the pump to flow the condensate water. In addition, the controller 50 closes the first valve 15, and opens the second valve 16.

When the pump 1 is operated, the condensate water stored into the condensate water tank 70 is flown along with the condensate water pipe 72. Further, the refrigerant discharged from the compressor 11 is flown along with the diverge pipe 14, and is heat-exchanged with the condensate water at the heat exchanger 24. After the refrigerant heat-exchanged with the condensate water moves into the connection pipe 13, it is flown into the condenser 20, and the condensate water heat-exchanged with the refrigerant is flown into the condensate water tank 70 again.

When the condensate water is circulated, the temperature sensor 51 senses the temperature of the condensate water and the controller 50 determines whether the temperature of the condensate water is above the first standard temperature.

In addition, when the temperature of the condensate water is above the first standard temperature, the controller 50 stops the operation of the pump 74 to stop the circulation of the condensate water, to open the first valve 15, and to close the second valve 16. Then, the refrigerant compressed from the compressor 11 is flown into the condenser 20 without passing through the heat exchanger 24.

In addition, after the circulation of the condensate water is stopped, the controller 50 determines whether the temperature of the condensate water is below the second standard temperature lower than the first standard temperature. In addition, when the temperature of the condensate water is below the second standard temperature lower than the first standard temperature, it circulates the condensate water again after determining whether the water level of the condensate water reaches the standard water level.

Figure 6:
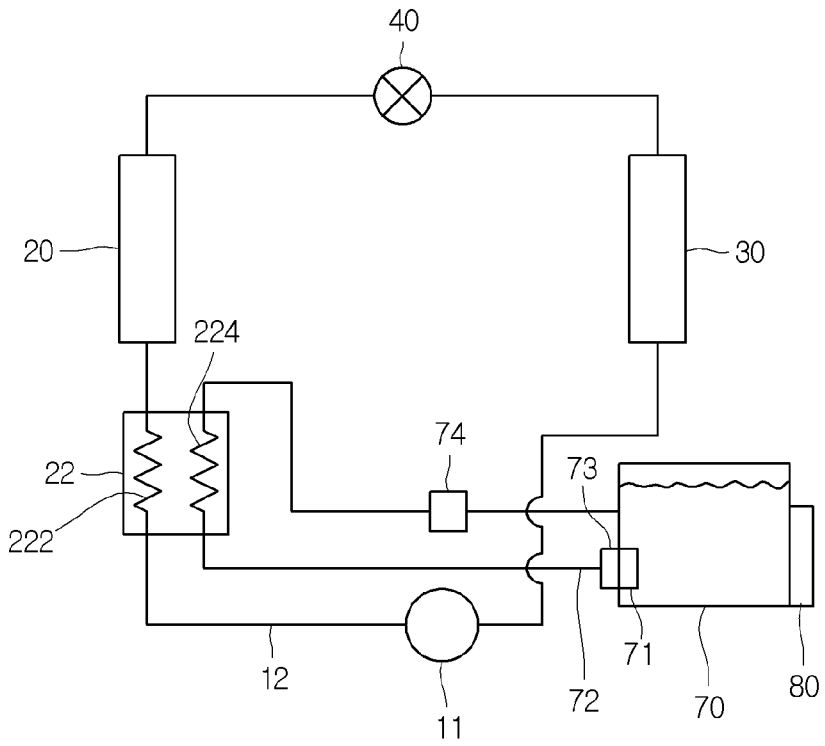
FIG. 6 schematically shows the dehumidifier according to a third embodiment of the present invention.

FIG. 6 schematically shows the dehumidifier according to a third embodiment of the present invention.

Some other sections of the present embodiment are the same as the first embodiment or the second embodiment, but it is characterized in that the condensate water tank is contacted with a container accommodated with phase change material. Therefore, hereinafter, characteristic sections only in the present embodiment will be described. FIG. 6 shows an example that the container contacts the condensate water tank of the first embodiment.

Referring to FIG. 6, the container 80 accommodated with phase change material contacts the condensate water tank 70 of the present embodiment. The phase change material plays a role as cold storage medium as an example.

Therefore, when the temperature of the condensate water is raised, temperature raising width for the condensate water may be reduced by the phase change material such that circulation time or circulation amount of the condensate water may be raised.

Figure 7:
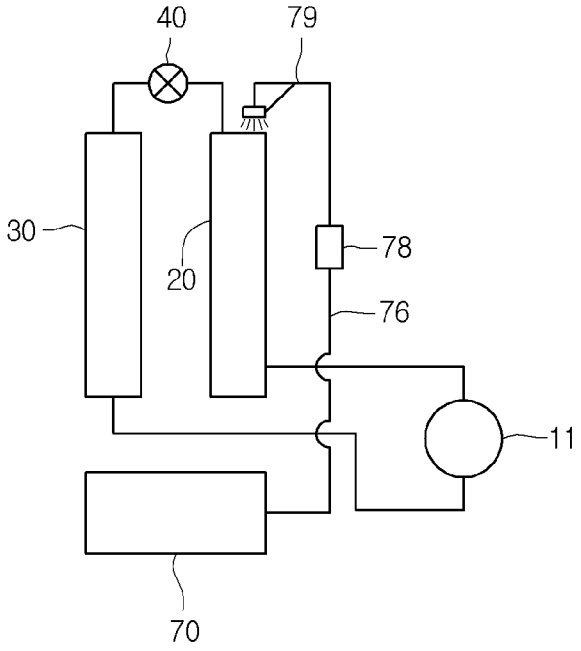
FIG. 7 schematically shows the dehumidifier according to a fourth embodiment of the present invention.

FIG. 7 schematically shows the dehumidifier according to a third embodiment of the present invention.

Referring to FIG. 7, the dehumidifier of the present embodiment may include the condensate water pipe 76 for moving the condensate water at the condensate water tank 70 above the condenser 20. The condensate water pipe 76 may be disposed with a pump 78 for pumping water. In addition, an end portion of the condensate water pipe 76 may be connected with an injection nozzle 79. The injection nozzle 79 may be disposed above the condenser 20.

Therefore, the condensate water is injected from an upper part of the condenser 20 into the condenser 20, and therefore the condensing temperature at the condenser 20 may be lowered, thereby to lower discharge temperature of air.

The condensate water injected into the condenser 20 may be evaporated by heat at the condenser 20, and the condensate water, that is not evaporated, may be flown into the condensate water tank 70 again.

It is described that water stored into the condensate water tank is circulated in the above embodiment, but it is possible to dispose a separable fixed condensate water tank besides a separable condensate water tank and to circulate the condensate water only stored into the fixed condensate water tank.

Further, it is possible to use the fixed condensate water tank only without having the separable condensate water tank.

In addition, when both of the separable condensate water tank and the fixed condensate water tank are used, the container accommodated into the phase change material maintains contacts for both of the tanks to circulate the condensate water at the fixed condensate water tank.

In the above embodiment, it is described that the condensate water pipe is disposed with the pump, but the pump may be omitted in the case that pressure difference between two points in a water tank is adequately secured.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dehumidifier, comprising:

a body having an inlet for suctioning air and an outlet for discharging air;

a compressor, disposed at the body, for compressing a refrigerant;

an air-cooled condenser for condensing the refrigerant compressed from the compressor by heat-exchanging with air passing through the condenser;

an expander for expanding the refrigerant condensed from the condenser;

an evaporator, disposed upstream of the condenser according to the flow direction of air, for evaporating the refrigerant expanded from the expander;

a condensate water tank to store condensate water condensed from the evaporator and separately coupled with the body;

a condensate water pipe connected to the condensate water tank, for flowing the condensate water after discharging the condensate water outside the condensate water tank; and a heat exchanger, wherein the condensate water pipe is connected to the heat exchanger and is heat-exchanged, via the heat exchanger, with a portion of a connection pipe for connecting the compressor and the condenser, and wherein the condensate water tank comprises:

a connection portion connected to the condensate water pipe; and a valve installed at the connection portion so as to be opened when the condensate water tank and the condensate water pipe are connected and closed when the condensate water tank and the condensate water pipe are separated from each other, wherein the connection pipe comprises:

a first connection pipe, wherein the first connection pipe bypasses the heat exchanger;

a second connection pipe diverged from the first connection pipe, wherein the second connection pipe is connected to the heat exchanger;

a first valve disposed at the first connection pipe; and a second valve disposed at the second connection pipe, and wherein the portion of the connection pipe is the second connection pipe.

2. The dehumidifier according to claim 1, wherein the condensate water pipe collects condensate water discharged from the condensate water tank into the condensate water tank.

3. The dehumidifier according to claim 1, wherein the condensate water pipe heat-exchanges the condensate water flowing through the condensate water pipe with the refrigerant on the refrigerant flow path.

4. The dehumidifier according to claim 1, wherein the condensate water pipe is in contact with the condenser.

5. The dehumidifier according to claim 1, wherein the condenser includes a refrigerant flow path for flowing the refrigerant compressed from the compressor, and a condensate water flow path for flowing the condensate water at the condensate water pipe.

6. The dehumidifier according to claim 1, wherein at least some of the condensate water pipe is disposed downstream of the condenser according to the flow direction of air.

7. The dehumidifier according to claim 1, further comprising a container, contacting the condensate water tank, for accommodating phase change material.

8. The dehumidifier according to claim 1, further comprising a pump disposed at the condensate water pipe.

9. The dehumidifier according to claim 1, further comprising:

a water level sensor for sensing water level of the condensate water tank, a temperature sensor for sensing the temperature of the condensate water at the condensate water tank or the condensate water pipe, and a controller for controlling flow of the condensate water based on information sensed from the water level sensor and the temperature sensor.

10. The dehumidifier according to claim 9, wherein the controller controls flow for the condensate water to flow the condensate water when the water level of the condensate water tank is above a standard water level.

11. The dehumidifier according to claim 9, wherein the controller stops the flow for the condensate water when the temperature of the condensate water is above a first standard temperature, and controls the flow for the condensate water to flow the condensate water when the temperature of the condensate water is below a second standard temperature lower than the first standard temperature.

* * * * *